US010186783B2

(12) United States Patent
Liao

(10) Patent No.: US 10,186,783 B2
(45) Date of Patent: Jan. 22, 2019

(54) MODIFIED ANTIPODAL VIVALDI ANTENNA WITH ELLIPTICAL LOADING

(71) Applicant: U.S. Army Research Laboratory ATTN: RDRL-LOC-I, Adelphi, MD (US)

(72) Inventor: DaHan Liao, Laurel, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 236 days.

(21) Appl. No.: 15/060,687

(22) Filed: Mar. 4, 2016

(65) Prior Publication Data

US 2017/0256860 A1 Sep. 7, 2017

(51) Int. Cl.
*H01Q 13/08* (2006.01)

(52) U.S. Cl.
CPC ..... *H01Q 13/085* (2013.01); *H01Q 13/08* (2013.01)

(58) Field of Classification Search
CPC ..... H01Q 13/085; H01Q 13/08
USPC ..... 343/767
See application file for complete search history.

(56) References Cited

U.S. PATENT DOCUMENTS 6,559,810 B2 * 5/2003 McCorkle ..... H01Q 1/38 343/786
6,911,951 B2 * 6/2005 Dotto ..... H01Q 1/36 343/767
9,325,075 B1 * 4/2016 Lam ..... H01Q 13/085
9,504,404 B1 * 11/2016 Shao ..... A61B 5/4312

* cited by examiner

*Primary Examiner* — Hoang Nguyen
*Assistant Examiner* — Walter Davis
(74) *Attorney, Agent, or Firm* — Guy M. Miller; Eric Brett Compton

(57) ABSTRACT

A Vivaldi antenna having an upper conductor and a lower conductor. A signal connector feed is attached to a rear end of the conductors while each conductor includes a curved flare section extending forwardly for the reception or transmission of the signal. Each conductor includes elliptical loading section or sections disposed around its flare section to enhance performance of the antenna by improving the front to back ratio as well as other factors for the antenna.

18 Claims, 6 Drawing Sheets

(a) 0.5 GHz (b) 0.75 GHz (c) 1.0 GHz (d) 1.25 GHz (e) 1.5 GHz (f) 1.75 GHz (g) 2.0 GHz (h) 2.25 GHz (i) 2.5 GHz (j) 2.75 GHz (k) 3.0 GHz (a) 0.5 GHz (b) 0.75 GHz (c) 1.0 GHz (d) 1.25 GHz (e) 1.5 GHz (f) 1.75 GHz (g) 2.0 GHz (h) 2.25 GHz (i) 2.5 GHz (j) 2.75 GHz (k) 3.0 GHz

MODIFIED ANTIPODAL VIVALDI ANTENNA WITH ELLIPTICAL LOADING

GOVERNMENT INTEREST

The invention described herein may be manufactured, used, and licensed by or for the United States Government

BACKGROUND OF THE INVENTION

I. Field of the Invention

The present invention relates generally to radio antennas and, more particularly, to high frequency Vivaldi antennas.

II. Description of Related Art

The Vivaldi antenna (essentially a tapered slot antenna) is a well-known radiator for ultra-wideband sensing and communications applications. This type of antenna is attractive because it is compact (low profile), light weight, and cost effective to fabricate, in addition to having relatively high directivity. Over the years, various topologies for the Vivaldi antenna have been developed. The three main classes include the cavity-based conventional Vivaldi antenna, the antipodal Vivaldi antenna, and the balanced-antipodal Vivaldi antenna. Each of these variants lass its own advantages and disadvantages. Compared to the antipodal implementation, it is expected that both the cavity-based and the balanced structures have lower cross-polarization interference effects. The cavity-based and balanced designs, however, are more complicated to fabricate due to the need to embed the feeding element (impedance transformer) within the substrate layer.

Variations of the above three Vivaldi classes also have been introduced, derived from either properly shaping the conductor geometry or modifying the substrate layer and dielectric composition, in order to further improve the radiation characteristics or miniaturize the structure. For example, slots or corrugated edges can be added to the flared sections of the antenna to achieve a more compact form factor, and a dielectric director can be embedded in the substrate to enhance the gain of the radiator.

SUMMARY OF THE PRESENT INVENTION

In brief like some previously known variants, the Vivaldi topology of the present invention comprises an antipodal structure having an upper conductor and a lower conductor mounted to a thin substrate. The rear ends of the two conductors are overlapping and form a feed point for coupling with radiofrequency inlet. Both conductors, furthermore, flare exponentially outwardly from the rear end to the front end of the antenna in the transmission direction for the antenna.

Unlike the previously known Vivaldi antennas, however, the topology of the present invention includes at least one elliptical loading section disposed around each of the flared sections on the upper and lower conductors. These elliptical loading sections enhance the constructive interference in the forward direction of the signal wave and, simultaneously, create destructive interference in the rearward direction. Together, the overall front to back ratio of the antenna can be systematically improved. As such, better performance can be achieved with the antenna of the present invention without increasing the size or footprint of the radiator.

While there are various types of antipodal Vivaldi antennas, the present design overcomes the limitations of the prior art as it is optimized for the targeted frequency band of 0.5-3.0 GHz, which is a popular band of interest for sensing applications such as ground-penetrating radar and through-wall imaging. In particular, the present design extends the lower frequency limit down to 0.5 GHz while retaining a relatively small footprint The structure still has reasonably low cross-polarization. Moreover, a systematic elliptical loading strategy is put forth here to reduce the backward radiation and thus resulting in an overall structure that radiates more energy in the forward direction. It is important to note that this strategy improves the radiation pattern of the antenna without affecting the impedance matching performance.

As such, in sum, the key advantages include:

(1) It has a smaller footprint which is optimized for the targeted frequency range of 0.5-3 GHz. The present design is 30% smaller than comparable prior art antennas at the lower frequency range.

(2) It radiates more energy in the forward direction while reducing backward radiation: the systematic elliptical design/loading results in a reduction by as much as 10 dB at some frequencies in the upper portion of the band.

(3) The elliptically loaded design does not degrade impedance matching: the antenna demonstrates a −10 dB reflection coefficient in simulations over the targeted band.

(4) It is easy to fabricate since the elliptical loading sections are simple to implement.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
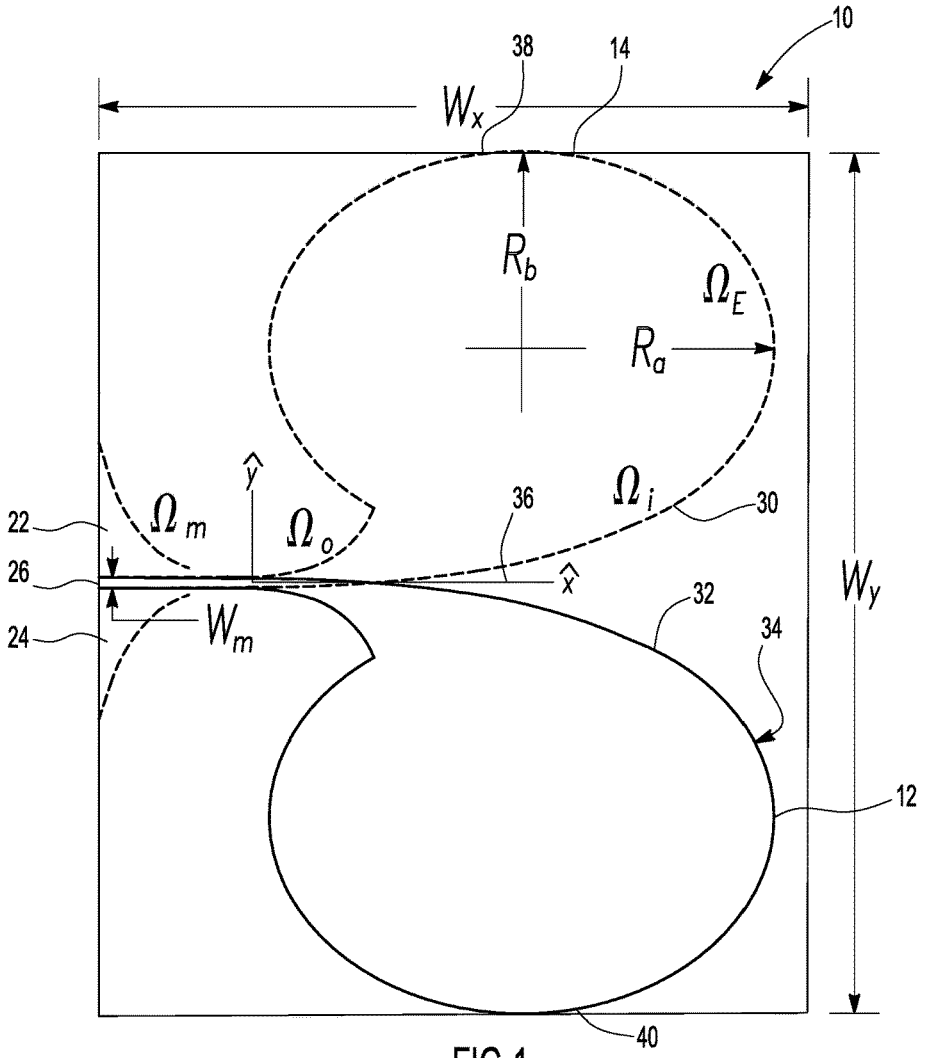
FIG. 1 is a top plan view of a first embodiment of the invention.
Figure 2:
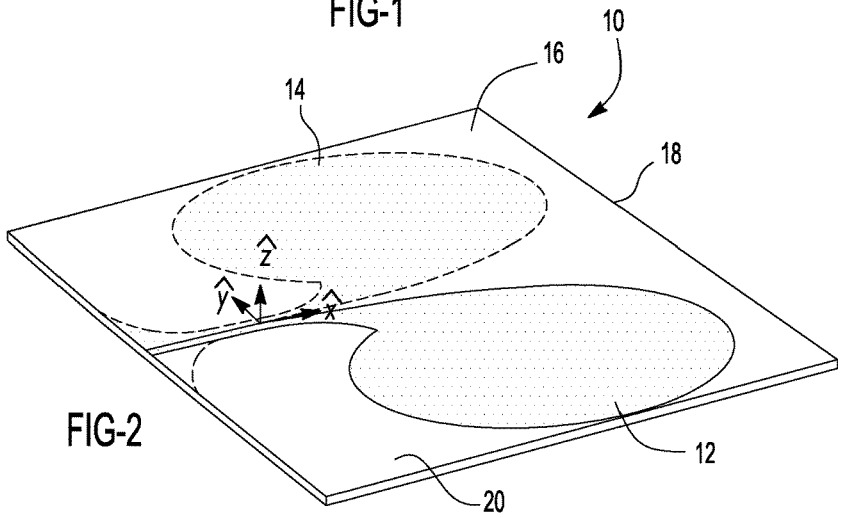
FIG. 2 is a perspective view of the first embodiment of the invention.

With reference first to FIGS. 1 and 2, a first preferred embodiment of a Vivaldi antenna 10 according to the present invention is shown. The antenna 10 includes an upper conductor 12 and a lower conductor 14. Each conductor 12 and 14 is constructed, for example, by milling a standard dielectric substrate with a copper layer on both sides.

The upper conductor 12 is mounted on an upper side 16 of a dielectric substrate 18. Conversely, the lower conductor 14 is disposed on a lower side 20 of the substrate 18. The substrate 18 itself is a standard commercial off-the-shelf component that is thin in thickness, typically no more than a few millimeters.

As best shown in FIG. 1, the upper conductor 12 has a rear or signal input end 26 with a constant width $w_m$. A signal input end 24 of the lower conductor 14 forms the ground plane and is exponentially tapered on each side along a curve $\Omega_m$, thus forming two fins 22/24. The signal input end 26 of the upper conductor 12 is positioned midway between the fins 22/24. Conventional means, such as a coaxial feed, may be used to convey the signal to signal input 26.

Both the upper conductor 12 and the lower conductor 14 flare exponentially outwardly in flared sections 30 and 32, respectively, toward a front end 34 of the antenna 10. These flared sections 30 and 32 together form a traveling wave antenna to transmit the signal introduced at the input 26 forwardly from the antenna 10 in the forward direction indicated by arrow 36.

Unlike the previously known Vivaldi antennas, however, the antenna 10 of the present invention includes an elliptical section 38 (or $\Omega_E$) disposed around the flared section 30 of the upper conductor 12 and, likewise, an elliptical section 40 disposed around the flared section 32 on the lower conductor 14. Each elliptical loading section 38 and 40 is formed with a semi-major radius of $R_a$ and a semi-minor radius $R_b$.

For the antenna 10 shown in FIGS. 1 and 2, only a single elliptical loading section 38 or 40 is provided for the upper conductor 12 or lower conductor 14. Furthermore, these elliptical sections 38 and 40 are dimensioned to enhance the signal by constructive interference in the forward direction 36 while simultaneously reducing the backward transmission of the signal from the antenna 10 by destructive interference.

Although only a single elliptical loading section is provided for each of the conductors 12 and 14 in FIGS. 1 and 2, the use of additional (properly optimized) elliptical loading sections can further enhance the antenna performance, enabling pattern control without affecting the impedance matching. For example, with reference now to FIGS. 3 and 4, a modified antenna 10' is illustrated in which, instead of the single elliptical loading sections 38 and 40 for each of the conductors 12 and 14, five elliptical loading sections 42 are disposed around the flared sections 30 and 32 for the upper and lower conductors 12 and 14, respectively. The number of elliptical loading sections here (i.e., the number being 5) is optimized through electromagnetic simulations. Each of these elliptical loading sections 42, furthermore, includes a semi-major radius $r_b$ and a semi-minor radius $r_a$. The dimensions of the elliptical loading sections 42, as before, are designed to enhance the forward transmission of the signal by constructive interference in the forward direction 36 while reducing the rearward transmission of signal by destructive interference.

The dimensions for the upper and lower conductors 12 and 14, together with the elliptical loading sections 38 and 40 or the elliptical loading sections 42, will vary depending upon the desired range of frequency transmission for the antenna. Here the antenna designed for the frequency range of 0.5 GHz to 3 GHz is desired and that the antenna 10 will be fed by a coaxial connector, such as an SMA edge launcher. The antenna conductors 12 and 14 are printed on two sides of a Rogers RO4003 substrate having a thickness of 1.5 mm, a relative dielectric constant $\in_1$ of 3.38, and a loss tangent tan δ of 0.0027. The coaxial to tapered slot line transition is in the form of a microstrip line section consisting of a constant-width upper conductor and an exponentially tapered ground plane $\Omega_m$ (see FIG. 1).

Figure 3:
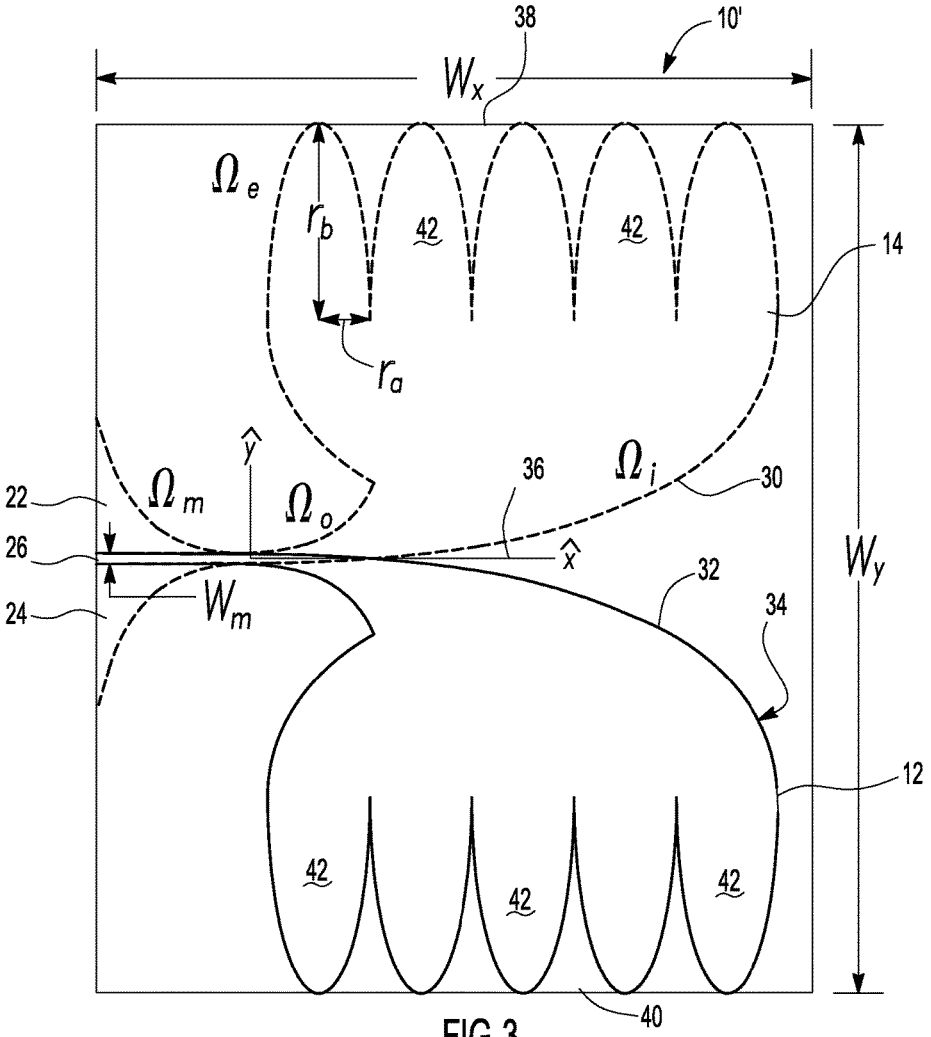
FIG. 3 is a view similar to FIG. 1, but illustrating a second preferred embodiment of the invention.
Figure 4:
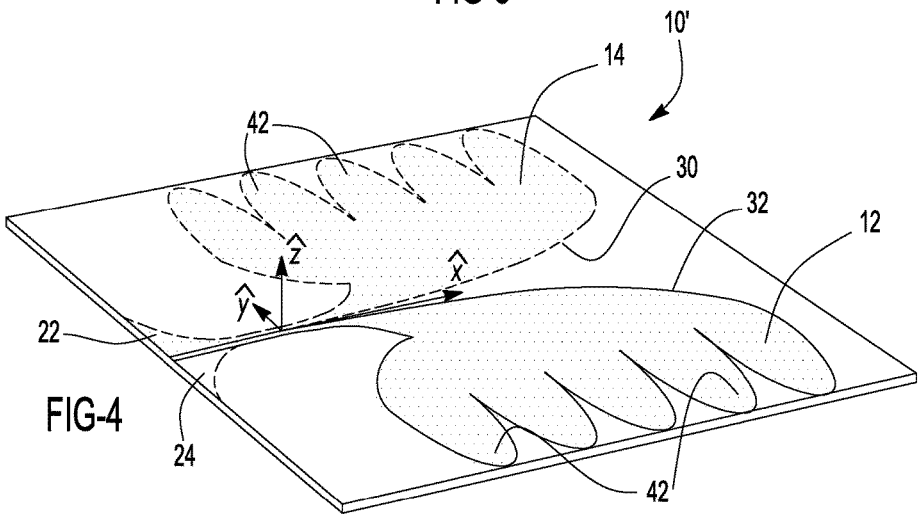
FIG. 4 is a view similar to FIG. 2, but illustrating the second preferred embodiment of the invention.

The width $w_m$ (FIGS. 1 and 3) of the upper conductor 12 at the signal input is initially determined with microstrip line theory assuming a characteristic impedance of 50 Ω. The slot line flare sections ($\Omega_o$ and $\Omega_i$) are composed of exponentially tapered carves on the upper and lower conductors. The profiles of the exponential flare sections ($\Omega_m$, $\Omega_i$, and $\Omega_o$) are given by the general expression:

$$y=\pm\tfrac{1}{2}[\alpha_u(e^{\beta_u x}-1)+\gamma_u w_m],$$

where u=m, i and o (for α, β, and γ), corresponding to $\Omega_m$, $\Omega_i$, and $\Omega_o$, respectively. The parameters for the designs in FIGS. 1 and 3 are shown in Table 1 below:

TABLE 1

| | |
|---|---|
| $w_x$ | 195 |
| $w_y$ | 236.1 |
| $w_m$ | 3 |
| $\alpha_m$ | 1.3 |
| $\beta_m$ | −0.1 |
| $\gamma_m$ | 1 |
| $\alpha_i$ | 2 |
| $\beta_i$ | 0.027 |
| $\gamma_i$ | −1 |
| $\alpha_o$ | 0.8 |
| $\beta_o$ | 0.11 |
| $\gamma_o$ | 1 |
| $R_a$ | 70 |
| $R_b$ | 53 |

The values in Table 1 are determined and optimized systematically by computer simulations, as the antenna performance is very sensitive to the values of the parameters shown.

In the first embodiment of the antenna 10 shown in FIGS. 1 and 2, only a single elliptical loading section 38 or 40 is provided for the conductor 12 or 14, respectively. The two fins are smoothly transitioned, as aforementioned, to elliptical loading sections $\Omega_E$ with semi-major and semi-minor radii of $R_a$ and $R_b$, respectively.

A further improvement upon the radiation characteristics of the design shown in FIG. 1 is achieved when the elliptical loading sections 38 and 40 are decomposed into N semi-elliptical subsections $\Omega_e$ with radii of $r_b=R_b$ and $r_a=R_a/N$, where N=1 for the design of FIG. 1.

Figure 5:
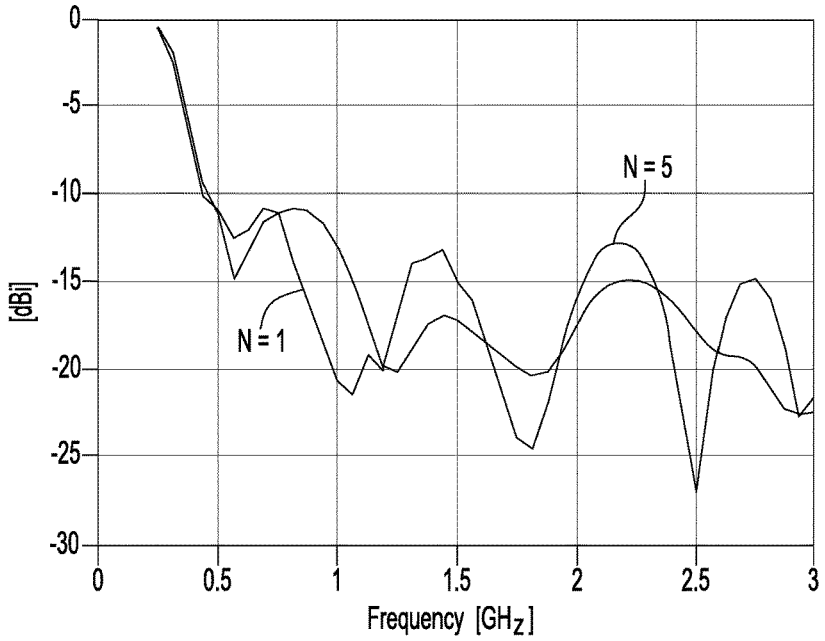
FIG. 5 is a graph of the reflection coefficient of an exemplary antenna over the selected frequency range.
Figure 6:
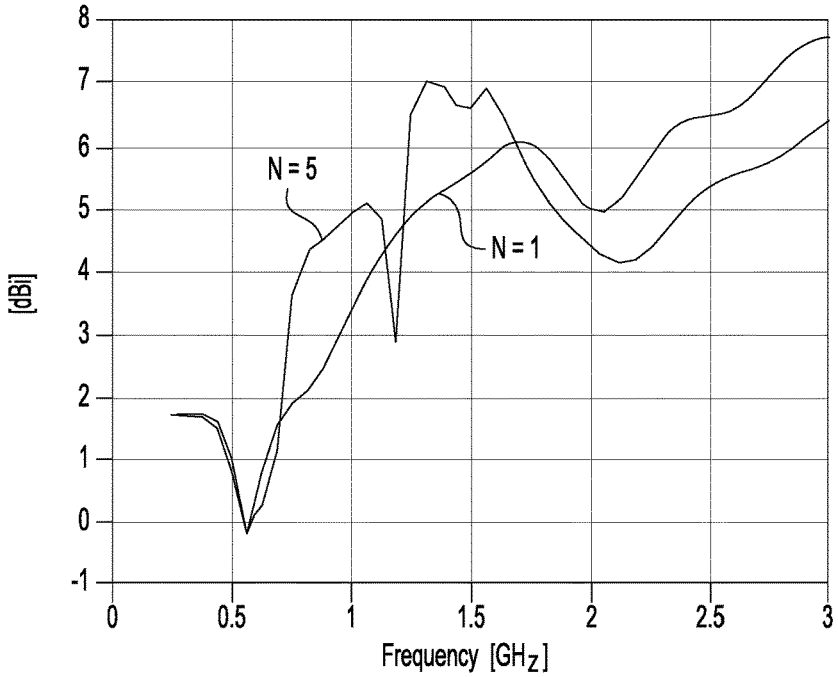
FIG. 6 is a graph of the gain over the selected frequency range of the antenna.
Figure 7A:
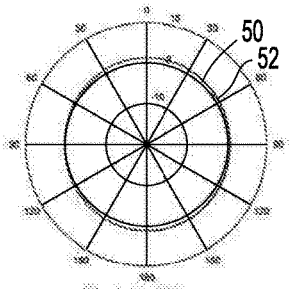
FIGS. 7(*a*)-7(*k*) are E-plane radiation patterns for selected frequencies for the antenna embodiments of the present invention.
Figure 7B:
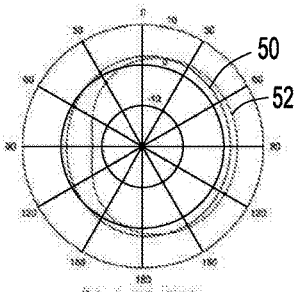
Figure 7C:
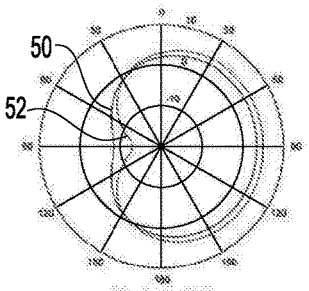
Figure 7D:
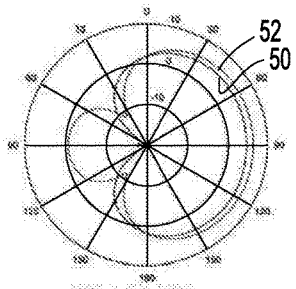
Figure 7E:
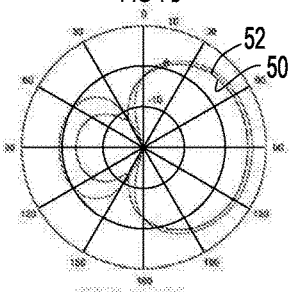
Figure 7F:
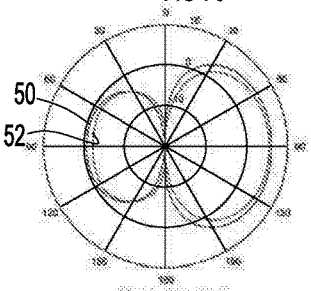
Figure 7G:
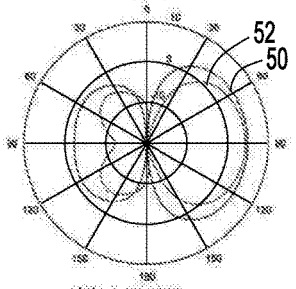
Figure 7H:
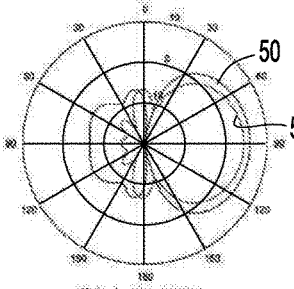
Figure 7I:
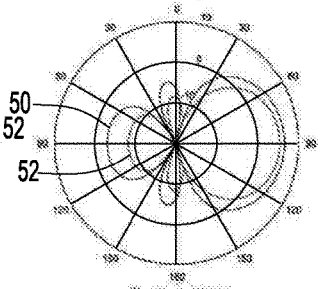
Figure 7J:
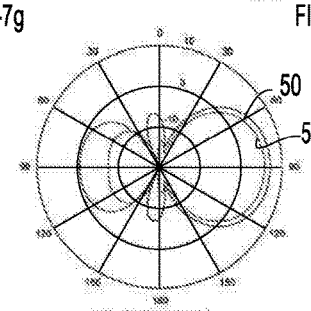
Figure 7K:
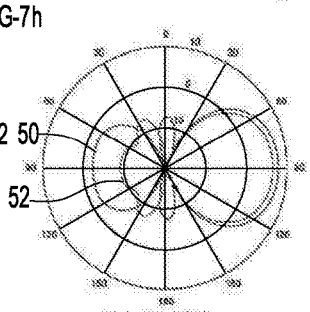
Figure 8A:
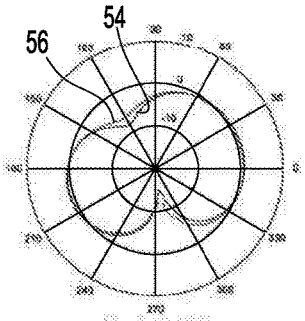
FIGS. 8(*a*)-8(*k*) are H-plane radiation patterns for selected frequencies for the antenna embodiments of the present invention.
Figure 8B:
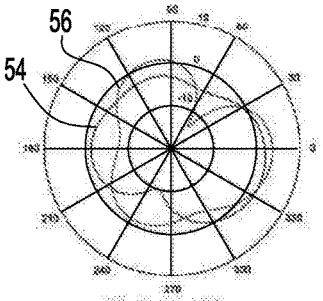
Figure 8C:
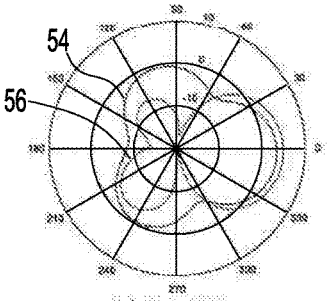
Figure 8D:
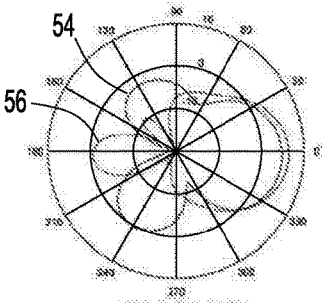
Figure 8E:
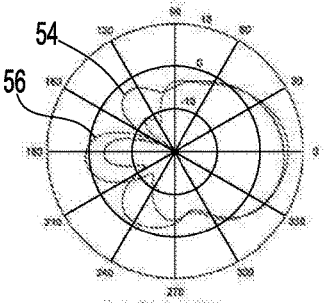
Figure 8F:
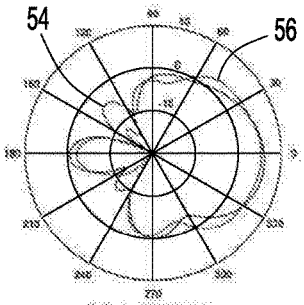
Figure 8G:
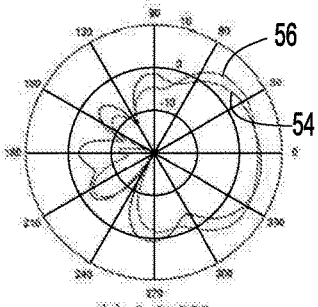
Figure 8H:
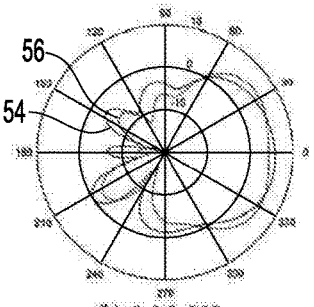
Figure 8I:
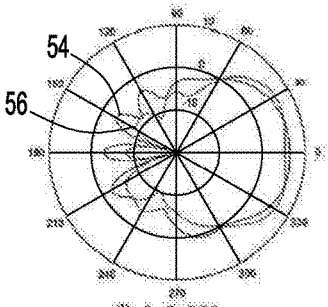
Figure 8J:
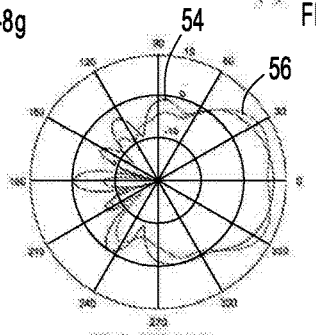
Figure 8K:
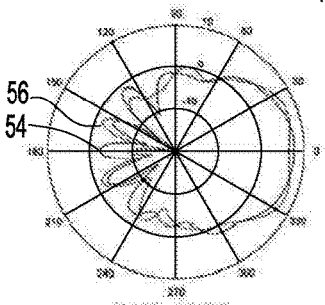

With the values shown in Table 1, the overall, antenna topology (either 10 or 10') has a maximum cross-sectional dimension of 236.1×195 $mm^2$. The reflection coefficient performance is shown in FIG. 5 for both N=1 (FIG. 1) and N=5 (FIG. 3) embodiments of the invention. As shown in FIG. 5, acceptable performance for the antenna with a reflection coefficient of less than −10 dB is achieved for the entire frequency range of 0.5 GHz through 3 GHz, with a minimum reflection coefficient of about −27 dB for the antenna configuration shown in FIG. 3.

The gain functions for the antennas over the frequency range of 0.5 GHz to 3 GHz are shown in FIG. 5 for the cases with both the single elliptical loading section as well as five elliptical loading sections. A maximum gain of about 7.75 dB is obtained for the antenna with five elliptical loading sections at 3 GHz.

With reference now to FIGS. 7 and 8, the H-plane radiation pattern and E-plane radiation pattern are shown for both embodiments of the invention at a variety of different frequencies ranging from 0.5 GHz to 3.5 GHz. The graphs for N=1 are labeled 50 and for N=5 are labeled 52 in FIG. 7. Similarly, in FIG. 8 the graphs for N=1 are labeled 54 and for N=5 are labeled 56. As can be seen from both FIGS. 7 and 8, the antennas of the present invention exhibit substantial antenna gains and high front to back ratio for the transmission in both the E- and H-planes, especially at the higher frequencies.

Figure 9:
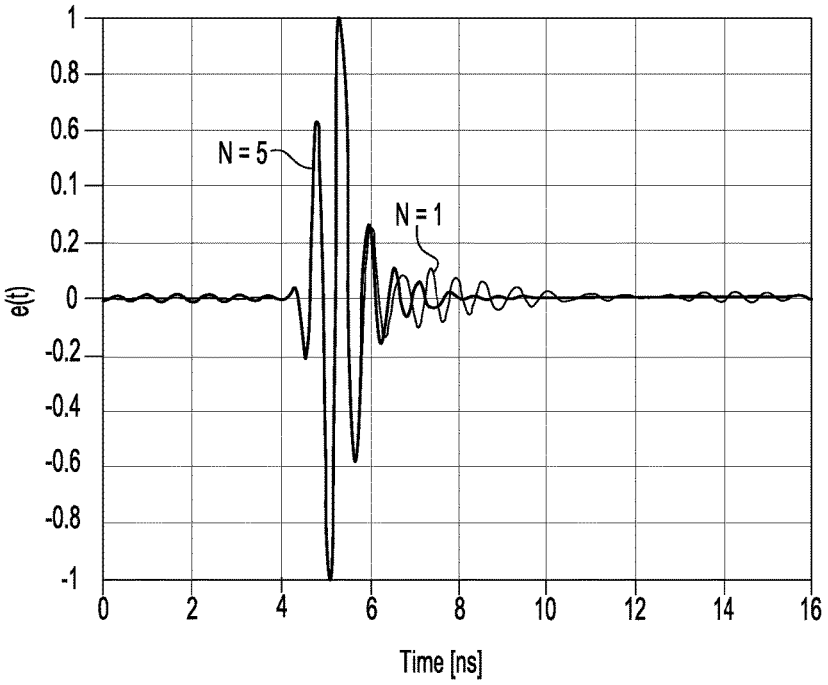
FIG. 9 is a time domain response of the antenna embodiments of the present invention.

FIG. 9 represents the time domain response for both antenna embodiments of the present invention. As can be seen from FIG. 9, the antennas exhibit little ringing and rapid dampening in response to a pulse signal.

From the foregoing, it can be seen that the present invention provides a significant improvement in Vivaldi antennas by providing the elliptical loading section or sections for the two conductors. In particular, the Vivaldi antenna of the present invention achieves improved and controllable front to back ratio and improved antenna gain while still maintaining an input impedance of approximately 50 Ω over the frequency range of the antenna.

Having described my invention, however, many modifications thereto will become apparent to those skilled in the art to which it pertains without deviation from the spirit of the invention as defined by the scope of the appended claims.

I claim:

1. A Vivaldi antenna comprising:

an upper conductor and a lower conductor, said conductors having a rear signal feed, each conductor having a curved flare section extending forwardly from said rear signal feed, each conductor having an elliptical loading section disposed around its said curved flare section.

2. The Vivaldi antenna as defined in claim 1 wherein said conductors are mounted on a dielectric substrate.

3. The Vivaldi antenna as defined in claim 2 wherein said conductors are mounted on opposite sides of said dielectric substrate.

4. The Vivaldi antenna as defined in claim 3 wherein each conductor comprises an electrically conductive foil.

5. The Vivaldi antenna as defined in claim 1 wherein said antenna comprises an antipodal Vivaldi antenna.

6. The Vivaldi antenna as defined in claim 1 wherein said elliptical loading section is dimensioned to optimize destructive interference in the rearward direction.

7. The Vivaldi antenna as defined in claim 1 wherein said elliptical loading section is dimensioned to optimize constructive interference in the forward direction.

8. The Vivaldi antenna as defined in claim 1 wherein an outer half of each elliptical loading section is decomposed into N semi-elliptical subsections.

9. The Vivaldi antenna as defined in claim 8 wherein N equals five.

10. The Vivaldi antenna as defined in claim 8 wherein the elliptical loading section includes a semi-major radius $R_a$ and semi-minor radius $R_b$.

11. The Vivaldi antenna as defined in claim 10 wherein the N semi-elliptical subsections each include a semi-major radius $r_b$ and semi-minor radius $r_a$, where $r_b=R_b$ and $r_a=R_a/N$.

12. The Vivaldi antenna as defined in claim 1 wherein said upper conductor has a constant width at a rear end of said upper conductor.

13. The Vivaldi antenna as defined in claim 1 wherein said lower conductor comprises two outwardly flared fins at a rear end of said lower conductor.

14. The Vivaldi antenna as defined in claim 13 wherein said two outwardly flared fins are formed along an exponential curve.

15. The Vivaldi antenna as defined in claim 1 wherein the rear signal feed of the upper conductor receives a signal input for the antenna.

16. The Vivaldi antenna as defined in claim 1 wherein the rear signal feed of the lower conductor is grounded.

17. A Vivaldi antenna comprising:

a dielectric substrate having an upper side and a lower side;

an upper conductor provided on the upper side of the substrate;

a lower conductor provided on the lower side of the substrate;

a first rear signal feed connected to the upper conductor that receives a signal input for the antenna; and a second rear signal feed connected to the lower conductor that is grounded, wherein each of the upper conductor and the lower conductor has a curved flare section extending forwardly from said first and second rear signal feeds, respectively, and has an elliptical loading section disposed around its said curved flare section.

18. The Vivaldi antenna as defined in claim 17, wherein the elliptical loading sections of the upper conductor and the lower conductor are substantially symmetric to each other even though on different sides of the substrate.

* * * * *